United States Patent [19]

Ellis et al.

[11] Patent Number: 4,491,489

[45] Date of Patent: Jan. 1, 1985

[54] METHOD AND MEANS FOR MAKING AN EXPLOSIVE IN THE FORM OF AN EMULSION

[75] Inventors: David Ellis, Croyden; Jeremy G. B. Smith, Edenvale; Pieter S. J. Halliday, Randburg, all of South Africa

[73] Assignee: AECI Limited, Johannesburg, South Africa

[21] Appl. No.: 539,405

[22] Filed: Oct. 6, 1983

[30] Foreign Application Priority Data

Nov. 17, 1982 [ZA] South Africa ..... 82/8466

[51] Int. Cl.[3] ..... D03D 23/00

[52] U.S. Cl. ..... 149/109.6; 149/2; 264/3 R; 264/3 D

[58] Field of Search ..... 149/109.6, 2; 264/3 R, 264/3 D

[56] References Cited

U.S. PATENT DOCUMENTS

| | | | |
|---|---|---|---|
| 4,014,655 | 3/1977 | Brunnberg | 149/50 X |
| 4,141,767 | 2/1979 | Sudweeks et al. | 149/61 X |
| 4,216,040 | 8/1980 | Sudweeks et al. | 149/61 X |

*Primary Examiner*—Stephen J. Lechert, Jr.

*Attorney, Agent, or Firm*—Cushman, Darby & Cushman

[57] ABSTRACT

A method of making an explosive in the form of an emulsion, which includes two stages being a first stage comprising directing a plurality of 0.5 to 5 mm diameter jets of the discontinuous phase into the continuous phase, in the presence of an emulsifier, and feeding the continuous phase containing the discontinuous phase through a static mixer to form a relatively coarse, fuel-rich emulsion; and a second stage comprising directing a plurality of 0.5 to 5 mm diameter jets of the discontinuous phase into the continuous phase of said coarse emulsion, and feeding the coarse emulsion with the added discontinuous phase through two further static mixers arranged in series. The invention further extends to an apparatus for performing the method of the invention.

17 Claims, 6 Drawing Figures

METHOD AND MEANS FOR MAKING AN EXPLOSIVE IN THE FORM OF AN EMULSION

This invention relates to an explosive. In particular the invention relates to a method and apparatus for making an explosive of the emulsion type in which an oxidising salt-containing component forms the discontinuous phase in an emulsion wherein the continuous phase comprises a fuel component which is immiscible with the discontinuous phase.

Such explosives, where the oxidising salt-containing component contains water and is in the form of an aqueous solution are known as "water-in-fuel" emulsions, and when the oxidising salt component includes no water they can be regarded as "melt-in-fuel" emulsions.

The emulsion is formed by dispersing the discontinuous phase in the continuous phase when they are both in liquid form, but the expression "emulsion" is intended to be construed as covering also the emulsions at temperatures below that at which they were formed, so that the discontinuous phase may be a solid.

According to the invention there is provided a method of making an explosive in the form of an emulsion comprising a discontinuous phase which includes an oxidising salt, and a continuous phase which includes a fuel and which is immiscible with the discontinuous phase, and method including directing a plurality of 0,5 to 5 mm diameter jets of the discontinuous phase into the continuous phase, in the presence of an emulsifier, and feeding the continuous phase with the discontinuous phase through at least one mixer.

Thus the method may include two stages, being a first stage comprising directing a plurality of jets of the discontinuous phase into the continuous phase, in the presence of an emulsifier, and feeding the continuous phase containing the discontinuous phase through a static mixer, to form a relatively coarse, fuel-rich emulsion; and a second stage comprising directing a plurality of the jets of the discontinuous phase into the continuous phase of said coarse fuel-rich emulsion, and feeding the coarse emulsion with the added discontinuous phase through a further static mixer, to form a relatively fine emulsion.

The method may further include passing the emulsion through several static mixers in series in the second stage to obtain a finer emulsion.

The relative flow rates of the continuous and discontinuous phases are important and the method may include controlling these flow rates such that a percentage phase volume by volume of 6% to 10% fuel component and 90 to 94% oxidiser component is obtained in the final emulsion product. The method may include introducing 50% to 60% of the oxidiser component required in the final emulsion product into the continuous phase in the first stage, and introducing the remainder of the oxidiser component, being 20% to 50%, into the continuous phase in the second stage. By "percentage phase volume by volume" is meant the percentage of a component (i.e. the continuous or discontinuous phase) in the emulsion on a volume basis.

The method of the invention may include heating the discontinuous phase and/or the continuous phase to decrease the viscosities thereof before directing the jets of the discontinuous phase into the continuous phase.

The method further may include splitting a feed stream of the discontinuous phase into the plurality of jets for directing into the continuous phase.

The oxidising salt may comprise a member selected from the group consisting of alkali metal nitrates,
alkali metal perchlorates,
alkaline earth metal nitrates,
alkaline earth metal perchlorates,
ammonium nitrate
ammonium perchlorate, and
mixtures of two or more thereof.

The oxidising salt may be present as an aqueous solution. Instead, the discontinuous phase may comprise ammonium nitrate and one or more compounds which, together with the ammonium nitrate, form a melt which has a melting point which is lower than that of the ammonium nitrate, the compounds being capable of acting as oxygen releasing salts.

The fuel will be immiscible with and insoluble in water and is preferably a non self-explosive organic fuel, being for example selected from the group consisting of hydrocarbons, halogenated hydrocarbons and mixtures of two or more thereof. Thus the fuel may comprise a member selected from the group consisting of mineral oils, fuel oils, lubricating oils, liquid paraffin, microcrystalline waxes, paraffin waxes, petrolatum, xylene, toluene, dinitrotoluene and mixtures of two or more thereof.

The fuel may form from about 2 to 25% by weight of the emulsion, preferably being in the region of about 3 to 12% by weight thereof.

The emulsifier may comprise a member selected from the group consisting of sorbitan sesquioleate, sorbitan monooleate, sorbitan monopalmitate, sorbitan monostearate, sorbitan tristearate, and mono- and di-glycerides of fat-forming fatty acids, soya bean lecithin, derivatives of lanolin, alkyl benzene sulphonates, oleyl acid phosphate, laurylamine acetate, decaglycerol decaoleate, decaglycerol decastearate, polymeric emulsifiers containing polyethylene glycol back bones with fatty acid side chains, and suitable mixtures of two or more thereof.

The emulsifiers act as stabilizers to promote the formation of the emulsion and to combat coalescing and/or crystallization of the discontinuous phase.

In general, when the discontinuous phase contains water, this water should be kept at a minimum consistent with forming a satisfactory emulsion and the prevention of wasted energy arising from steam production upon detonation.

The density of the explosive emulsion should be suitable for forming an explosives composition, and preferably may be between 1.30 g/ml and 1.45 g/ml at 25° C. The method of the invention may thus include adding a density reducing agent such as microballoons to the emulsion to provide a desired density for the explosives composition, eg. 1.15–1.20 g/ml at 25° C. The emulsion may comprise up to 3% and preferably 0.5 to 2.5%, by weight of the microballoons, which also act to sensitize the explosive. Chemical gassing may instead be used for density control and sensitizing.

The invention extends to an apparatus for performing the method of the invention, which includes a device which provides a plurality of apertures of 0.5 to 5 mm diameter for directing a plurality of jets of the discontinuous phase into the continuous phase; and at least one mixer for mixing the continuous phase with the discontinuous phase provided by the jets.

The device may define a passage for receiving a stream of the discontinuous phase, said apertures forming outlets from the passage for splitting the stream into said plurality of jets.

The apparatus may include a first stage and a second stage, the device and a mixer in the form of a static mixer constituting the first stage, and a further said device and a further static mixer constituting the second stage.

The second stage may comprise a plurality of static mixers arranged in series.

The static mixers of the first and second stages may be different, the first stage mixer being preferably of a high shear type which is more appropriate for liquids of a relatively low viscosity such as the coarse emulsion formed during the first stage of the method. The second stage mixer(s) may be preferably of the low shear type which is more appropriate for liquids of a relatively high viscosity such as the finer emulsion(s) formed during the second stage of the method.

The apparatus may include pumps for pumping the continuous and discontinuous phases under turbulent flow conditions through the static mixers to form a suitable emulsion.

Each of the pumps may have its inlet connected to a storage tank provided with a heating means and forming a part of the apparatus.

The Applicant has found Sulzer SMV static mixers suitable for use as the first stage static mixer, and Sulzer SMX static mixers suitable for use as the or each second stage static mixer. In general, suitable static mixers for the method of the invention will be those capable of inducing a turbulent flow sufficient to form the required emulsion. The Applicant believes that these include mixers having a smallest internal diameter of ¼" to 2" (ie 6 to 50 mm) and preferably ⅜" to 1" (ie 10 to 25 mm), with 5 to 15 static mixer elements which in use appropriately divide and subdivide a liquid stream passing through the mixer, at a flow rate of from 20 to 200 kg/min and a pressure of up to $1\times10^7$Pa. Then the apertured device may define 5 to 15, and preferably 10 to 12 apertures which may be preferably 2 to 3 mm in diameter.

The invention is now described by way of the following non-limiting examples, with reference to the accompanying diagrammatic drawings in which FIG. 1 is a schematic view of an apparatus according to the invention for performing the method of the invention;

Figure 1:
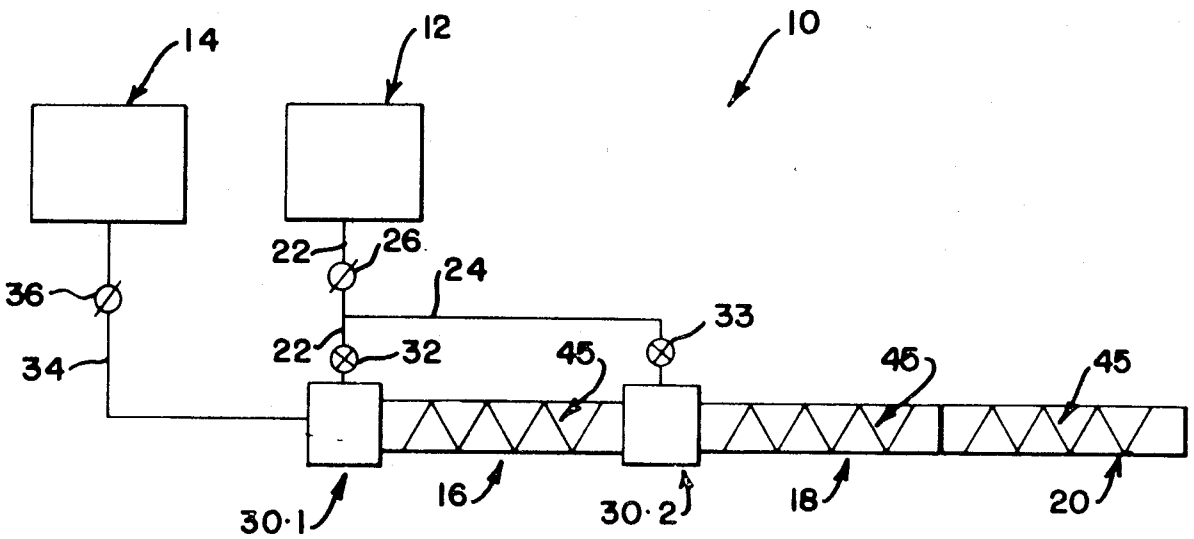

In FIG. 1, reference numeral 10 generally indicates an apparatus according to the invention, for performing the method of the invention wherein an explosive emulsion is formed by dispersing an oxidising salt component in a fuel component.

The apparatus 10 includes a thermally insulated tank 12 for the oxidising salt component and a thermally insulated tank 14 for the fuel component.

The apparatus 10 also includes three static mixers 16, 18 and 20 respectively. The static mixer 16 is a high shear Sulzer SMV mixer, and the mixers 18 and 20 are both low shear Sulzer SMX mixers.

Figure 4:
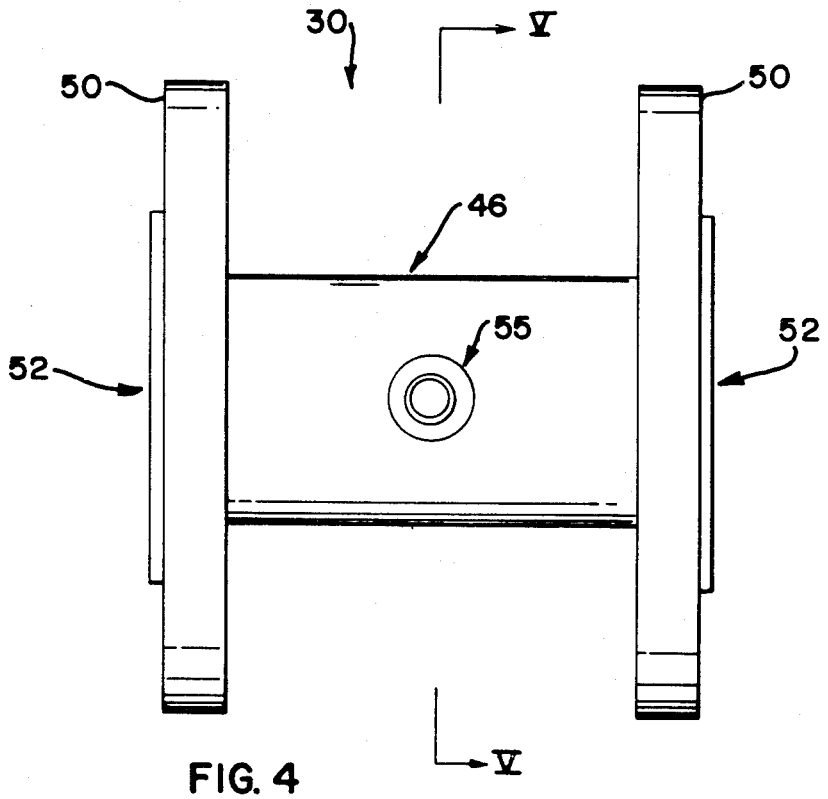
FIG. 4 is a side view of an inlet member which is a component of the apparatus of FIG. 1.
Figure 5:
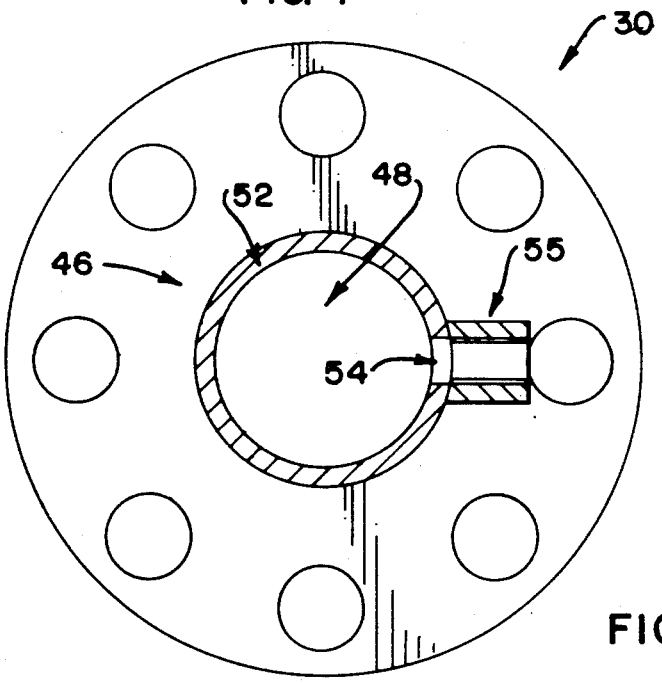
FIG. 5 is a sectional view through V—V of the inlet member of FIG. 4.

Two inlet members 30 (ie 30.1 and 30.2) (see also FIGS. 4 and 5) are arranged in series with the static mixers 16, 18 and 20 in the following configuration: inlet member 30.1—static mixer 16—inlet member 30.2—static mixer 18—static mixer 20.

The tank 12 communicates respectively with the inlet members 30.1 and 30.2 via feed tubes 22 and 24 provided with a pump 26 for pumping the oxidising salt component, at a suitable pressure and flow rate, from the tank 12 and into the inlet members 30.1 and 30.2. Ball valves 32 and 33 which are adjustable to be partly or fully open, are provided in the feed tubes 22 and 24.

The tank 14 communicates with the inlet member 30.1 via a feed tube 34 provided with a pump 36 for pumping the fuel component from the tank 14 and into the inlet member 30.1.

Figure 2:
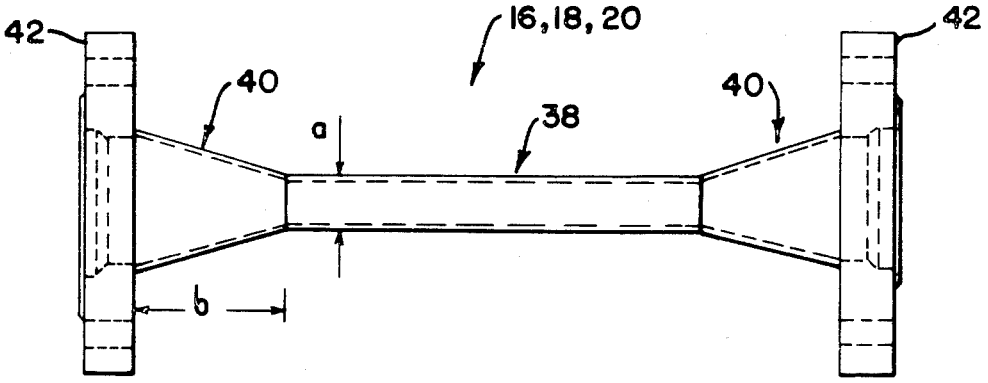
FIG. 2 is a side view of a static mixer casing which is a component of the apparatus of FIG. 1.
Figure 3:
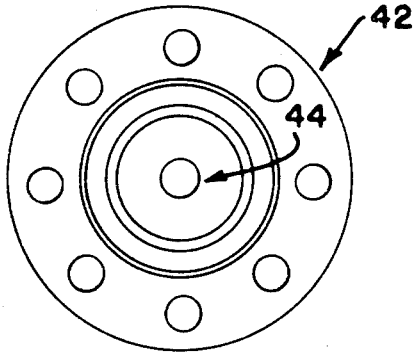
FIG. 3 is an end view of the static mixer casing of FIG. 2.

Each of the static mixers 16, 18 and 20 (see FIGS. 2 and 3) comprises an elongate tubular portion 38 having an internal diameter a of ⅜" to 1" (ie 10 to 25 mm), two hollow, frusto conical end portions 40 of length b of 50 mm which flare outwardly from the ends of the portion 38; and two disc-like flanges 42 which define apertures 44 therethrough and which sealingly engage the end portions 40.

The static mixers 16, 18 and 20 each contain about 10 mixer elements 45 (shown only in FIG. 1) which are selected in number and size to provide the desired emulsification.

Each of the inlet members 30 (FIGS. 4 and 5) comprises a hollow cylinder 46 which defines a cavity 48, and two end flanges 50 which define apertures 52 which communicate with the cavity 48.

A transverse bore 54 is provided in the wall of the cylinder 46, which leads from the cavity 48 to the exterior via a sleeve 55 which projects outwardly from the cylinder 46.

Each of the flanges 50 is similar to the flanges 42 and is connectable thereto, e.g. by bolts, such that their respective apertures 44 and 52 are in communication with each other.

Figure 6:
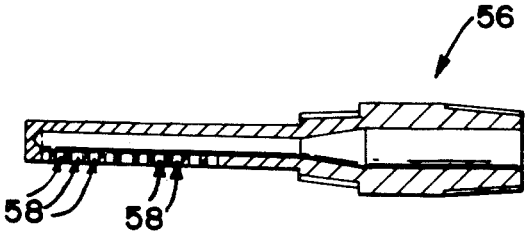
FIG. 6 is a longitudinal section of an apertured tube which is receivable in the inlet member of FIGS. 4 and 5.

An apertured tube 56 (see FIG. 6) having one closed end is receivable through the sleeve 55 and the bore 54. The tube 56 has a row of 11 apertures 58 along its length adjacent its closed end, which are of 2.5 mm diameter and are uniformly spaced from each other by a distance of 4 mm. When in its operative position, the tube 56 projects from the bore into the cavity 48 such that the entire row of apertures 58 is received therein, and the apertures 58 face downstream relative to the direction of flow of the emulsion/emulsion components in use.

The open end of one of the tubes 56 communicates with the feed tube 22, and the open end of the other of the tubes 56 communicates with the feed tube 24.

The use of the apparatus of the drawings is now described with reference to the following nonlimiting examples:

EXAMPLE 1

The following formulation which hitherto was considered by the Applicant to be suitable for bulk applications was used to produce an explosive emulsion with the apparatus 10 according to the invention.

| Component | % by mass |
|---|---|
| Ammonium nitrate | 57,88 |
| Sodium nitrate | 19,70 |
| Water | 15,31 |
| P95 Fuel Oil (paraffinic hydrocarbon fuel available from BP Southern Africa (Pty) Ltd.) | 4,21 |
| Span 80 (sorbitan mono oleate emulsifier available from Atlas Oil & Chemical Company (Pty) Ltd.) | 0,60 |
| Surfactant (a polymeric emulsifier) | 0,20 |
| Soya Lecithin | 0,60 |
| Revertex 272 for facilitating emulsification (Revertex 272 is an aqueous suspension of 45% by mass butyl acrylate/acrylonitrile particles in the size range 0,1–0,2 microns in 55% by mass water available from Revertex (South Africa) (Pty) Limited) | 1,00 |
| C15/250 microballoons (a density reducing agent and sensitiser available from 3M (South Africa) (Pty) Limited) | 0,50 |

The apparatus 10 was set up in the configuration shown in FIG. 1. The ammonium nitrate and water were mixed and heated to 85° C., whereafter the sodium nitrate and other oxidiser ingredients were added thereto, and heated and stirred in the tank 12 to form an oxidiser component. A fuel component comprising all the remaining constituents, except for the density reducing agents, were mixed, heated and stirred in the tank 14. The fuel component was pumped from the tank 14, by the pump 36 via the feed tube 34, through the inlet member 30.1 and the static mixer 16. Meanwhile a feed stream of the oxidiser component was pumped from the tank 12, by the pump 26 via the feed tube 22 and the associated apertured tube 56, through the inlet member 30.1 and into the static mixer 16. The apertured tube 56 split the feed stream of the oxidiser component into eleven jets thereof via the apertures 58. The jets of oxidiser component were directed into the fuel component in the mixer 16 and mixed therein by the mixer elements 45 (shown only in FIG. 1) which divided and repeatedly subdivided the jets to form droplets thereof dispersed in the fuel component to form an emulsion which, although relatively coarse, was a suitable feed for the second mixer 18.

The coarse emulsion was fed through the inlet member 30.2 and into the static mixer 18. Meanwhile a feed stream of the oxidiser component was pumped from the tank 12, via the feed tube 24 and the associated apertured tube 56, through the inlet member 30.2 and into the static mixer 18. The apertured tube 56 split the feed stream of the oxidiser component into eleven jets thereof which were directed into the coarse emulsion entering the mixer 18. A relatively refined emulsion was formed in the mixer 18. Finally, this relatively refined emulsion was fed through the static mixer 20 wherein an even more refined emulsion was formed.

The fuel component was fed into the static mixer 16, and the oxidiser component was fed into the static mixers 16 and 18 at respective flow rates and pressures such that the resulting emulsion was flowing through the mixers at a rate of 90 kg/min and a pressure of $1\times10^7$ Pa.

As mentioned above, the relative flow rates of the oxidiser and fuel components are important and can be controlled such that the percentage phase volume by volume is as low as 6% to 10% for the fuel component and as high as 90% to 94% for the oxidiser component. In the present example an emulsion having a percentage phase volume by volume of 6% fuel component and 94% oxidiser components was formed.

By controlling the flow rate of the oxidiser component, and the extent to which the valves 32 and 33 were open, 70% of the proportion of oxidiser component required in the final emulsion product was added to the fuel component in the mixer 16, and the remaining 30% to the fuel component in the mixer 18.

Finally, the density reducing agents were added at 65° C., which had the effect of increasing the sensitivity of the emulsion from the mixer 20, such that it detonated with 30 g Pentolite at 25° C. in a 65 mm plastic sleeve. Such sensitivity is suitable for emulsions for bulk explosives.

EXAMPLE 2

The following formulation which hitherto was considered by the Applicant to be suitable for bulk applications was used to produce an explosive emulsion with the apparatus 10 according to the method of the invvention:

| Component | % by mass |
|---|---|
| Ammonium nitrate | 57,88 |
| Sodium nitrate | 19,70 |
| Water | 15,31 |
| P95 Fuel Oil | 5,21 |
| Span 80 | 0,60 |
| Surfactant (a polymeric emulsifier) | 0,20 |
| Soya Lecithin | 0,60 |
| C15/250 Microballoons | 0,50 |

The procedure of Example 1 was repeated with the above formulation.

The resultant emulsion was of a sensitivity equivalent to the emulsion of Example 1, in that it detonated with 30 g Pentolite at 25° C. in a 65 mm plastic sleeve. The emulsion of Example 2 thus also is suitable for bulk explosives.

EXAMPLE 3

The following formulation which hitherto was considered by the Applicant to be suitable for small diameter applications was used to produce an explosive emulsion with the apparatus of the drawings according to the method of the invention.

| Component | % by mass |
|---|---|
| Ammonium nitrate | 60,89 |
| Sodium nitrate | 14,62 |
| Calcium nitrate | 3,59 |
| Water | 12,55 |
| P95 | 2,49 |
| Span 80 | 0,70 |
| Surfactant (a polymeric emulsifier) | 0,30 |
| Soya Lecithin | 0,70 |
| Sasolwax M (a hydraulic wax fuel obtainable from Sasol Marketing Company Limited) | 1,72 |
| C15/250 Microballoons | 2,44 |

The procedure of Example 1 was repeated with the above formulation.

The resultant emulsion was of a relatively high sensitivity, detonating with 0.022 g of pentaerythritol tetranitrate at 25° C. in a 25 mm waxed paper cartridge. Such sensitivity is suitable for explosive emulsions for small diameter explosives.

EXAMPLE 4

Example 3 was repeated with 0.5% microballoons being added instead of 2.44%, the relative proportions of the remaining constituents being kept substantially unchanged. The resultant emulsion was of decreased sensitivity compared to the emulsion of Example 3, detonating with 30 g pentolite at 25° C. in 65 mm plastic sleeve. This decreased sensitivity is equivalent to the sensitivity of the emulsions of Examples 1 and 2, and suitable for bulk explosives.

The formulation of Examples 3 and 4, when used to form an emulsion by the method of the invention, is thus suitable for use in both bulk and small diameter explosives, subject only to a variation in the proportion of microballoons added.

Hitherto, an emulsion explosive having a suitably small droplet size of oxidising salt component such that the emulsion is sufficiently sensitive for use in small diameter explosives, could be manufactured by the Applicant by batch processing only, the batch size being limited by the size of mechanical mixers available. With bulk production, only relatively coarse emulsions could be obtained from the available continuous operation methods. These relatively coarse emulsions, having a relatively large droplet size, require a higher proportion of sensitisers of the type described above, and lack extended shelf life.

The method of the invention provides a continuous "one-pass" operation whereby batch production may be obviated, a coarse emulsion suitable for refinement in the second stage being produced in line in the first stage of the method. Thus bulk production of emulsion explosives having a sufficiently small droplet size of oxidiser component, and hence a sufficiently high sensitivity for use in small diameter explosives and an extended shelf life is made possible. Thus relatively high costs of sensitisers which heretofore were required for sensitising the emulsion, may be reduced.

Hence the method of the invention, at least as exemplified, is advantageously simple and versatile.

Advantages of the apparatus for performing the method of the invention include the relatively inexpensive components thereof which are substantially maintenance free. Safety is enhanced as the static mixers have no moving parts and the apparatus can be assembled and disassembled relatively easily. Further, the apparatus is versatile in that various combinations of components, e.g. inlet members and/or static mixers can be used for controlling emulsion properties, thereby to provide emulsions suitable for both bulk and small diameter explosives according to the method of the invention.

We claim:

1. A method of making an explosive in the form of an emulsion comprising a discontinuous phase which includes an oxidising salt, and a continuous phase which includes a fuel and which is immiscible with the discontinuous phase, the method including directing a plurality of 0.5 to 5 mm diameter jets of the discontinuous phase into the continuous phase, in the presence of an emulsifier, and feeding the continuous phase with the discontinuous phase through at least one mixer.

2. A method as claimed in claim 1 which includes two stages, being a first stage which comprises directing a plurality of the jets of the discontinuous phase into the continuous phase, in the presence of an emulsifier, and feeding the continuous phase containing the discontinuous phase through a static mixer, to form a relatively coarse, fuel-rich emulsion; and a second stage which comprises directing a plurality of the jets of the discontinuous phase into the continuous phase of said coarse, fuel-rich emulsion, and feeding the coarse emulsion with the added discontinuous phase through a further static mixer, to form a relatively fine emulsion.

3. A method as claimed in claim 2 which includes passing the emulsion through several static mixers in series in the second stage to obtain a finer emulsion.

4. A method as claimed in claim 2 which includes controlling the relative flow rates of the continuous and discontinuous phases such that a percentage phase volume by volume of 6% to 10% continuous phase and 90% to 94% discontinuous phase is obtained in the final emulsion product.

5. A method as claimed in claim 1 which includes introducing 50% to 80% of the oxidiser component required in the final emulsion product into the discontinuous phase in the first stage, and introducing the remainder of the oxidiser component, being 20% to 50%, into the continuous phase in the second stage.

6. A method as claimed in claim 1 which includes heating the discontinuous phase and/or the continous phase to decrease the viscosities thereof before directing the jets of the discontinuous phase into the continuous phase.

7. A method as claimed in claim 1 which includes splitting a single feed stream of the discontinuous phase into the plurality of jets, before directing them into the continuous phase.

8. A method as claimed in claim 1 wherein the oxidising salt comprises a member of the group consisting of alkali metal nitrates, alkali metal perchlorates, alkaline earth metal nitrates, alkaline earth metal perchlorates, ammonium nitrate, ammonium perchlorate, and mixtures of two or more thereof.

9. A method as claimed in claim 1 wherein the emulsifier comprises a member of the group consisting of sorbitan sesquioleate, sorbitan monooleate, sorbitan monopalmitate, sorbitan monostearate, sorbitan tristearate, the mono- and di-glycerides of fat-forming fatty acids, soya bean lecithin, derivatives of lanolin, alkyl benzene sulphonates, oleyl acid phosphate, laurylamine acetate, decaglycerol decaoleate, decaglycerol decastearate, polymeric emulsifiers containing polyethylene glycol back bones with fatty acid side chains, and mixtures of two or more thereof.

10. A method as claimed in claim 1 wherein the fuel is a non self-explosive organic fuel selected from the group consisting of hydrocarbons, halogenated hydrocarbons and mixtures of two or more thereof.

11. A method as claimed in claim 10 wherein the fuel comprises a member selected from the group consisting of mineral oils, fuel oils, lubricating oils, liquid paraffin, microcrystalline waxes, paraffin waxes, petrolatum, xylene, tolene, dinitrotoluene and mixtures of two or more thereof.

12. A method as claimed in claim 1 which includes adding a density reducing agent to the emulsion to provide a density for the explosive of 1.15 to 1.20 g/ml at 25° C.

13. Apparatus for making an explosive in the form of an emulsion comprising a discontinuous phase containing an oxidizing salt and an immiscible continuous phase including a fuel, said apparatus including a static mixer having a mixing tube having an inlet end and an outlet end and containing static mixer elements; means for flowing the continuous phase through said inlet end and through said mixing tube under turbulent flow conditions to said outlet end; and means for injecting the discontinuous phase into the continuous phase prior to passage through said mixing tube in the form of a plurality of jets, said means including a device having a plurality of apertures of 0.5 to 5 mm diameter.

14. An apparatus as in claim 13, wherein the device defines a passage for receiving a stream of the discontinuous phase, said apertures forming outlets from the passage for splitting the stream into said plurality of jets.

15. Apparatus as in claim 13 wherein said static mixer receives the continuous phase from a source thereof, said apparatus further including: a second static mixer having an inlet end and an outlet end and containing static mixing elements, means for flowing the mixed phase from the outlet end of the first-mentioned mixer through the second mixer from its inlet end to its outlet end under turbulent flow conditions and means for injecting additional discontinuous phase into the mixed phase in the form of a plurality of jets of 0.5 to 5 mm diameter prior to passage of the mixed phase through said second mixer.

16. Apparatus as in claim 15 wherein the first mixer is a high shear mixer and the second mixer is a low shear mixer.

17. Apparatus as in claim 13 including pumps for pumping the continuous and discontinuous phases from separate storage tanks which are provided with heating means.

* * * * *